US011598067B2

(12) United States Patent
Hwang et al.

(10) Patent No.: US 11,598,067 B2
(45) Date of Patent: Mar. 7, 2023

(54) QUICK COUPLER CIRCUIT OF CONSTRUCTION MACHINE WITH AUTOMATIC PRESSURIZATION SYSTEM

(71) Applicant: Volvo Construction Equipment AB, Eskilstuna (SE)

(72) Inventors: Dongjin Hwang, Gyeongsangnam-do (KR); Seonggeun Yun, Gyeongsangnam-do (KR)

(73) Assignee: Volvo Construction Equipment AB, Eskilstuna (SE)

( * ) Notice: Subject to any disclaimer, the term of this patent is extended or adjusted under 35 U.S.C. 154(b) by 0 days.

(21) Appl. No.: 17/598,362

(22) PCT Filed: Mar. 27, 2019

(86) PCT No.: PCT/KR2019/003604
§ 371 (c)(1),
(2) Date: Sep. 27, 2021

(87) PCT Pub. No.: WO2020/196956
PCT Pub. Date: Oct. 1, 2020

(65) Prior Publication Data
US 2022/0186457 A1 Jun. 16, 2022

(51) Int. Cl.
*E02F 3/36* (2006.01)
*E02F 9/22* (2006.01)
*F15B 13/02* (2006.01)

(52) U.S. Cl.
CPC ..... *E02F 3/3663* (2013.01); *E02F 9/2228* (2013.01); *F15B 13/025* (2013.01); *E02F 9/2267* (2013.01); *E02F 9/2271* (2013.01)

(58) Field of Classification Search
CPC ..... E02F 3/3663; E02F 9/2228; E02F 3/3609
See application file for complete search history.

(56) References Cited

U.S. PATENT DOCUMENTS 5,147,173 A * 9/1992 Fauber ..... E02F 3/364 403/325
6,132,131 A * 10/2000 Nakamura ..... E02F 3/3663 37/468

(Continued)

FOREIGN PATENT DOCUMENTS

EP 2584099 A1 4/2013
JP 2007327291 A * 12/2007

(Continued)

OTHER PUBLICATIONS

International Search Report and Written Opinion of the International Searching Authority, PCT/KR2019/003604, dated Dec. 12, 2019, 9 pages.

(Continued)

*Primary Examiner* — Thomas E Lazo
(74) *Attorney, Agent, or Firm* — Sage Patent Group

(57) ABSTRACT

A quick coupler circuit includes a cylinder to attach and/or detach an attachment to and/or from a construction machine by expansion and/or contraction, a flow pump to supply fluid to the cylinder, a valve through which fluid for operating the cylinder passes, a spool valve which includes a spool, to move along an axial direction, and to form a pressure at a node of the flow pump according to movement of the spool, an electronic proportional pressure reducing valve to control the spool valve, a switch to perform an ON/OFF operation, and a controller to output a control current to the electronic proportional pressure reducing valve in response to the operation of the switch. The controller is maintains control current which it outputs during the switch's ON operation for a predetermined period of time after the switch's OFF operation.

14 Claims, 3 Drawing Sheets

(56) References Cited

U.S. PATENT DOCUMENTS

| | | | | |
|---|---|---|---|---|
| 6,964,122 | B2 * | 11/2005 | Cunningham | E02F 3/3663 37/468 |
| 7,367,256 | B2 * | 5/2008 | Fatemi | E02F 9/226 91/1 |
| 11,105,063 | B2 * | 8/2021 | Sato | E02F 3/40 |
| 2013/0160441 | A1 * | 6/2013 | Yokohata | E02F 3/3663 60/431 |
| 2016/0025215 | A1 | 1/2016 | Thoms et al. | |
| 2016/0326712 | A1 | 11/2016 | Koestler et al. | |

FOREIGN PATENT DOCUMENTS

| | | | |
|---|---|---|---|
| JP | 5462724 | B2 | 4/2014 |
| KR | 100682308 | B1 | 2/2007 |
| KR | 101793089 | B1 | 11/2017 |
| WO | 2015102120 | A1 | 7/2015 |
| WO | 2018158797 | A1 | 9/2018 |

OTHER PUBLICATIONS

Extended European Search Report dated Oct. 26, 2022 for European Patent Application No. 19922046.8, 9 pages.

* cited by examiner

[Fig. 1]
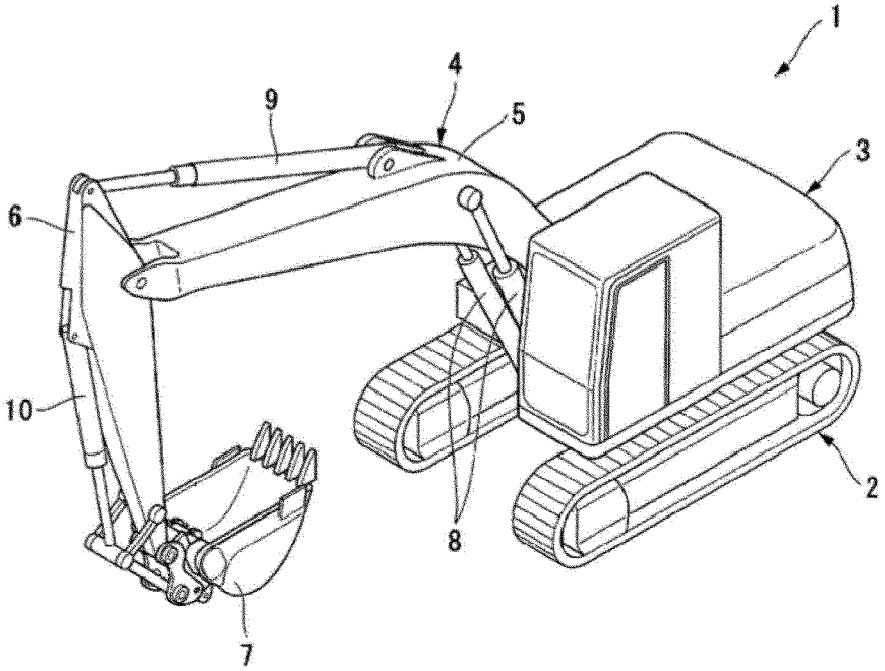
[Fig. 2]
A
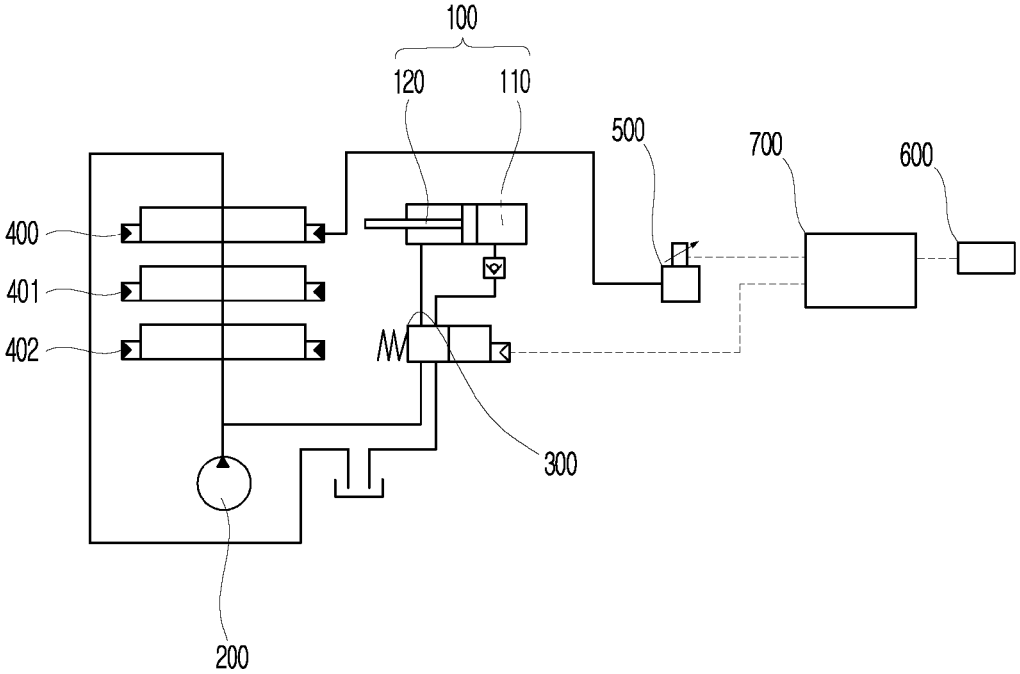

[Fig. 3]
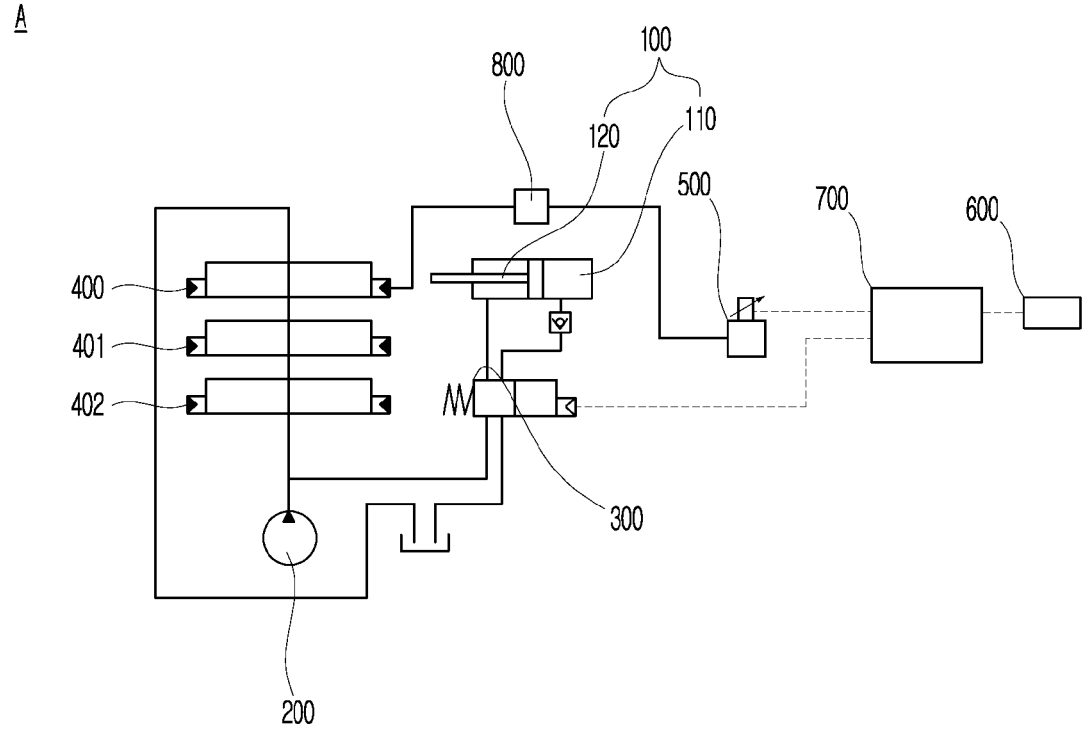
[Fig. 4]
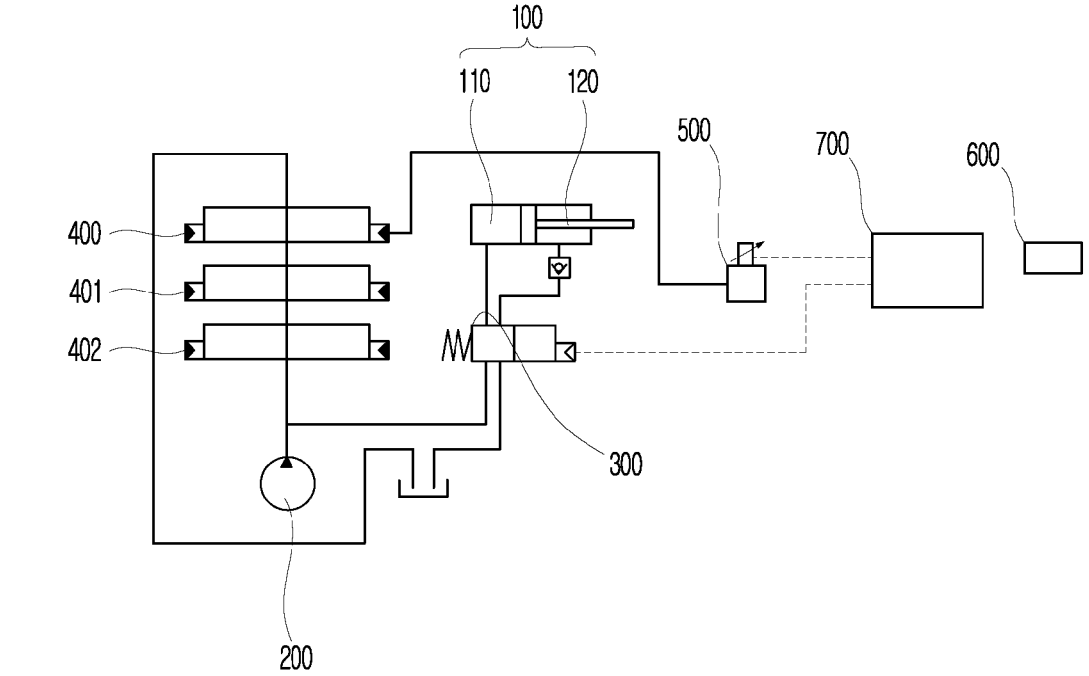

[Fig. 5]
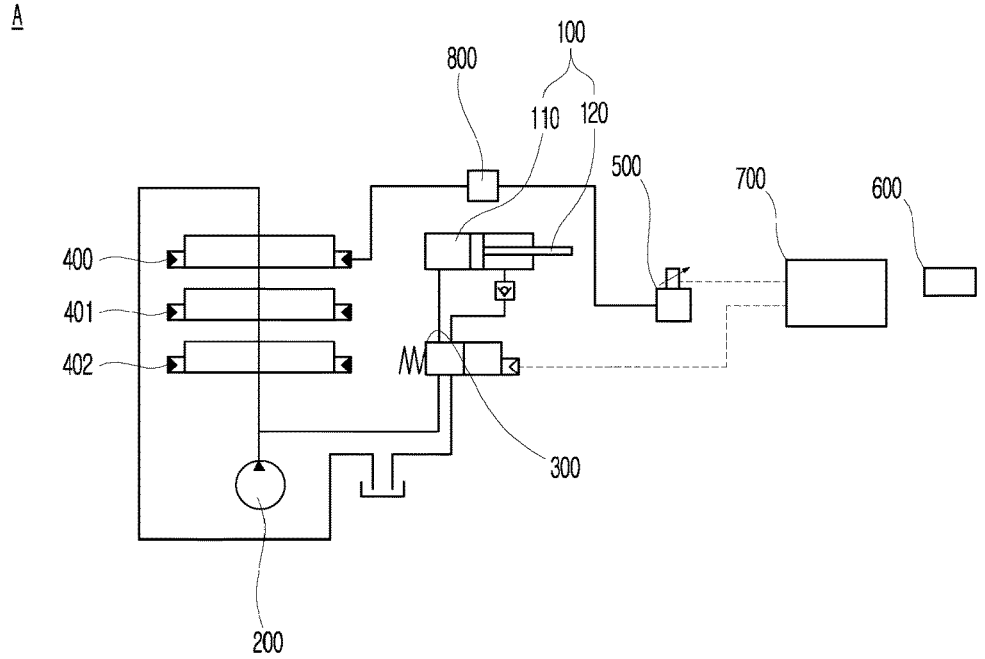
[Fig. 6]
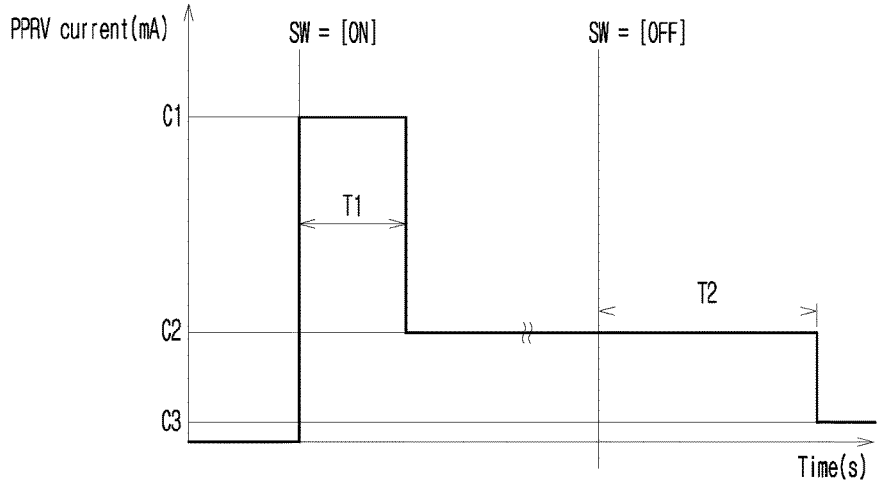
[Fig. 7]
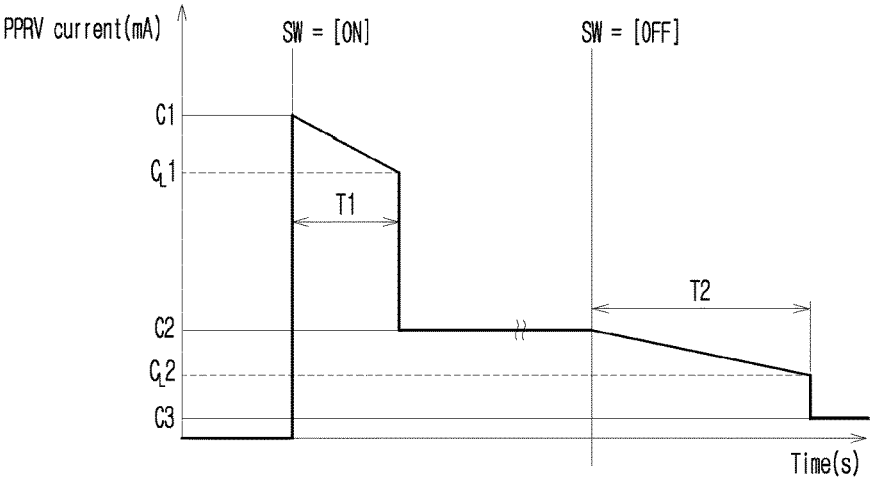

QUICK COUPLER CIRCUIT OF CONSTRUCTION MACHINE WITH AUTOMATIC PRESSURIZATION SYSTEM

CROSS REFERENCE TO RELATED APPLICATIONS

This application is a 35 U.S.C. § 371 national stage application of PCT International Application No. PCT/KR2019/003604 filed on Mar. 27, 2019, the disclosure and content of which is incorporated by reference herein in its entirety.

TECHNICAL FIELD

The present invention relates to a quick coupler circuit of a construction machine, and more particularly, to a quick coupler circuit of a construction machine with an automatic pressurization system for enhancing user convenience unlike the conventional manual pressurization system for small or medium equipment.

BACKGROUND ART

Generally, an excavator is a construction machine that mainly performs operations such as excavating, loading, shredding, ground clearing, etc. and is composed of a boom, an arm, and a bucket which are operated by hydraulic oil being supplied from a hydraulic pump to a hydraulic cylinder by the user manipulating an operation lever.

In FIG. 1, the construction machine 1 includes a lower traveling body 2, an upper revolving body 3 pivotally installed on the lower traveling body 2, and a working machine 4 installed on the upper revolving body 3 to be operatable in a vertical direction.

Further, the working machine 4 includes a boom 5 formed in a multi-joint shape and whose rear end is rotatably supported on the upper revolving body 3, an arm 6 whose rear end is rotatably supported on a front end of the boom 5, and a bucket (an attachment) 7 rotatably installed at a front end side of the arm 6. Hydraulic oil is supplied by the user manipulating a lever, and the boom 5, the arm 6, and the bucket 7 are operated by a boom cylinder (a working actuator) 8, an arm cylinder (a working actuator) 9, and a bucket cylinder (a working actuator) 10, respectively.

Meanwhile, a construction machine 1 in which an arm 6 has various types of attachments 7 such as a bucket, a breaker, a crusher, and the like which are detachably installed at a front end thereof is known. In such a construction machine 1, since the attachments 7 are configured to be exchangeable, one construction machine 1 may be used in a versatile and multifunctional manner. Further, a construction machine 1 which includes a quick coupler circuit and in which attachments 7 are easily and rapidly attached and detached by an operator manipulating a switch is known.

However, a method of a user moving a working device to increase a pressure, that is, a manual pressurizing method, is applied as the conventional quick coupler operating method applied to small or medium construction machine equipment.

In such a quick coupler operating method in which the pressure is manually applied, a low engine speed may become a problem and a pressure which is high enough to release the quick coupler cylinder sufficiently may not be made by the manual operation for pressurization. In addition, there is inconvenience in that two or more switches should always be provided in order to control a construction machine using the manual pressurizing method.

In the existing Japanese Patent No. 5,462,724, only a quick coupler circuit of a construction machine capable of simply controlling a time or timing of boosting, stabilizing an operation of a working machine during boosting of a hydraulic pump and improving fuel efficiency, is disclosed. Therefore, even with the technique in the above-described patent, there still remains a convenience problem of the user of the construction machine, which is caused by the application of the manual pressurizing method described above.

DISCLOSURE OF INVENTION

Technical Problem

The present invention is directed to providing a quick coupler circuit of a construction machine for improving a user's convenience by applying an automatic pressurization system in a method of controlling attachment and detachment of a multipurpose construction machine.

Solution to Problem

According to an aspect of the present invention, there is provided a quick coupler circuit of a construction machine with an automatic pressurization system, which includes a quick coupler cylinder configured to attach and/or detach an attachment to and/or from the construction machine by expansion and/or contraction, a flow pump configured to supply fluid to the quick coupler cylinder, a quick coupler valve through which fluid for operating the quick coupler cylinder passes, a spool valve which includes a spool, configured to move along an axial direction, and to form a pressure at a node of the flow pump according to movement of the spool, an electronic proportional pressure reducing valve configured to control the spool valve, a quick coupler switch configured to perform an ON/OFF operation, and a controller configured to output a control current to the electronic proportional pressure reducing valve in response to the operation of the quick coupler switch, wherein the controller is further configured to maintain control current which it outputs during the quick coupler switch's ON operation for a predetermined period of time after the quick coupler switch's OFF operation.

In an embodiment, the electronic proportional pressure reducing valve may generate a hydraulic pressure according to the control current of the controller and transmit the generated hydraulic pressure to the spool valve to operate the spool valve.

In an embodiment, when the quick coupler switch is ON, the controller may output a first control current C1 which causes a pressure that opens the electronic proportional pressure reducing valve to be formed for a predetermined first time T1.

In an embodiment, after the first time T1 has elapsed, the controller may output a second control current C2, which is relatively lower than the first control current C1, to the electronic proportional pressure reducing valve.

In an embodiment, when the quick coupler switch is OFF, the controller may output the second control current C2 to the electronic proportional pressure reducing valve for a predetermined second time T2.

In an embodiment, after the second time T2 has elapsed, the controller may output a third control current C3, which is relatively lower than the second control current C2, to the electronic proportional pressure reducing valve.

In an embodiment, the quick coupler circuit may further include a solenoid valve installed between the spool valve and the electronic proportional pressure reducing valve.

According to another aspect of the present invention, there is provided a quick coupler circuit of a construction machine with an automatic pressurization system, which includes a quick coupler cylinder configured to attach and/or detach an attachment to and/or from the construction machine by expansion and/or contraction, a flow pump configured to supply fluid to the quick coupler cylinder, a quick coupler valve through which fluid for operating the quick coupler cylinder passes, a spool valve which includes a spool, configured to move along an axial direction, and to form a pressure at a node of the flow pump according to movement of the spool, an electronic proportional pressure reducing valve configured to control the spool valve, a quick coupler switch configured to perform an ON/OFF operation, and a controller configured to output a control current to the electronic proportional pressure reducing valve in response to the operation of the quick coupler switch, wherein the controller is further configured to output a decreasing control current, which is reduced until the value reaches a predetermined limit control current value, during a predetermined period of time after the quick coupler switch's OFF operation.

In an embodiment, the electronic proportional pressure reducing valve may generate a hydraulic pressure according to the control current of the controller and transmit the generated hydraulic pressure to the spool valve to operate the spool valve.

In an embodiment, when of the quick coupler switch is ON, the controller may output a control current, which is reduced to reach a value of a first limit control current $C_L$1 lower than that of a first control current C1 which causes a pressure that opens the electronic proportional pressure reducing valve to be formed for a predetermined first time T1.

In an embodiment, after the first time T1 has elapsed, the controller may output a second control current C2, which is relatively lower than the first limit control current $C_L$1, to the electronic proportional pressure reducing valve.

In an embodiment, when the quick coupler switch is OFF, the controller may output a control current, which is reduced to reach a value of a second limit control current $C_L$2 lower than that of the second control current C2, to the electronic proportional pressure reducing valve for a predetermined second time T2.

In an embodiment, after the second time T2 has elapsed, the controller may output a third control current C3, which is relatively lower than the second limit control current $C_L$2, to the electronic proportional pressure reducing valve.

In an embodiment, the controller may output a control current, which is reduced to have a predetermined magnitude so as to reach a value of a predetermined limit control current for a predetermined period of time after the quick coupler switch's OFF operation.

In an embodiment, the quick coupler circuit may further include a solenoid valve installed between the spool valve and the electronic proportional pressure reducing valve.

According to another aspect of the present invention, there is provided construction equipment which is equipped with the quick coupler circuit.

Advantageous Effects of Invention

According to an aspect of the present invention, an operation of a quick coupler cylinder can be controlled by only one switch in an automatic pressurization system, inconvenience that a user should pressurize directly on an attachment can be reduced, and a convenience of the user who uses a construction machine can be ultimately improved.

The effects of the present invention are not limited to the above described effects, and it should be understood that all possible effects deduced from a configuration of the present invention described in detailed descriptions and the claims are included.

BRIEF DESCRIPTION OF DRAWINGS

FIG. 1 is a perspective view showing a basic configuration of a multipurpose construction machine;

FIG. 2 is a circuit diagram showing a quick coupler circuit of a construction machine according to an embodiment of the present invention;

FIG. 3 is a circuit diagram showing the quick coupler circuit of the construction machine including a solenoid valve according to an embodiment of the present invention;

FIG. 4 is a circuit diagram showing a quick coupler circuit of a construction machine according to another embodiment of the present invention;

FIG. 5 is a circuit diagram showing the quick coupler circuit of the construction machine including a solenoid valve according to another embodiment of the present invention;

FIG. 6 is a graph showing a change in control current with respect to an electronic proportional pressure reducing valve according to an embodiment of the present invention with time variation; and FIG. 7 is a graph showing a change in control current with respect to an electronic proportional pressure reducing valve according to another embodiment of the present invention with time variation.

MODE FOR THE INVENTION

Hereinafter, embodiments of the present invention will be described in detail with reference to FIGS. 1 to 7.

A construction machine 1 according to an embodiment of the present invention is an excavator, which includes a quick coupler circuit A for easily attaching and detaching various types of attachments 7 such as a bucket, a breaker, and the like to and from a front end of an arm 6 of a working machine 4.

FIGS. 2 to 5 are diagrams showing quick coupler circuits A according to various embodiments of the present invention and FIGS. 6 and 7 are graphs showing changes in control current with respect to an electronic proportional pressure reducing valve 500 with time variation.

The quick coupler circuit A of the construction machine 1 according to an embodiment of the present invention includes a quick coupler cylinder 100 configured to attach and/or detach an attachment 7 to and/or from the construction machine 1 by expansion and/or contraction, a flow pump 200 configured to supply fluid to the quick coupler cylinder 100, a quick coupler valve 300 through which fluid for operating the quick coupler cylinder 100 passes, a spool valve 400 which includes a spool, configured to move along an axial direction, and to form a pressure at a node of the flow pump 200 according to the movement of the spool, an electronic proportional pressure reducing valve 500 configured to control the spool valve 400, a quick coupler switch 600 configured to perform an ON/OFF operation, and a controller 700 configured to output a control current to the electronic proportional pressure reducing valve 500 in response to the operation of the quick coupler switch 600.

In the following, the ON/OFF signal of the quick coupler switch 600 and the ON/OFF operation of the quick coupler switch 600 represent the same meaning. The controller 700 according to an embodiment of the present invention is further configured to maintain control current which outputs during the quick coupler switch 600 for a predetermined time after the operation of the quick coupler switch 600's OFF operation.

The controller 700 according to another embodiment of the present invention is further configured to output the decreasing control current, which is reduced until the value to reaches a predetermined limit control current, for a predetermined period of time after the quick coupler switch 600's OFF operation.

In an operating method of the quick coupler circuit A to which the present invention is applied, the controller 700 which receives an operation signal of the quick coupler switch 600 outputs a control current to the electronic proportional pressure reducing valve 500 and a hydraulic pressure of the electronic proportional pressure reducing valve 500 formed thereby causes the spool valve 400 to operate.

The quick coupler cylinder 100 is a member which is expanded and contracted by supplying hydraulic oil and provided for attaching or detaching the attachment 7 to or from a front end of the arm 6 of the working machine 4 and may be composed of a piston chamber 110 and a load chamber 120. The quick coupler cylinder 100 may be embedded in a detachable device installed at the front end of the arm 6 and installed between the front end of the arm 6 and the attachment 7.

In this case, in an embodiment of the present invention, the attachment 7 may be configured to be mounted on the working machine 4 when the quick coupler cylinder 100 is expanded. In another embodiment, the attachment 7 may be configured to be detached from the working machine 4 when the quick coupler cylinder 100 is expanded.

That is, as shown in FIG. 2, in the quick coupler circuit A according to an embodiment of the present invention, a hydraulic pipe may be connected to each of the piston chamber 110 and the load chamber 120 of the quick coupler cylinder 100 such that the attachment 7 is mounted when the quick coupler cylinder 100 is expanded and the attachment 7 is detached when the quick coupler cylinder 100 is contracted.

Further, as shown in FIG. 4, in the quick coupler circuit A according to another embodiment of the present invention, a hydraulic pipe may be connected to each of the piston chamber 110 and the load chamber 120 of the quick coupler cylinder 100 such that the attachment 7 is detached when the quick coupler cylinder 100 is expanded and the attachment 7 is mounted when the quick coupler cylinder 100 is contracted.

The quick coupler valve 300 is a member for expanding and contracting the quick coupler cylinder 100. The quick coupler valve 300 may be formed with a solenoid valve and is connected to the quick coupler cylinder 100 through a hydraulic pipe so that hydraulic oil supplied by the flow pump 200 passes through the quick coupler valve 300 and is introduced into the quick coupler cylinder 100.

The spool valve 400 is a member which receives a pressure and opens and closes a flow path using the spool which moves in an axial direction. That is, the spool valve 400 serves to switch a supply direction of the hydraulic oil supplied by the flow pump 200, which is a hydraulic pressure source, toward the quick coupler cylinder 100. The spool valve 400 is connected to the flow pump 200 through a hydraulic pipe and forms a pressure at the node of the flow pump 200 to induce the hydraulic oil to be supplied from the flow pump 200 to the quick coupler cylinder 100.

Meanwhile, the hydraulic circuit of the construction machine to which the present invention is applied may additionally include attachment spool valves 401 and 402 of the working machine 4 in addition to the spool valve 400 which switches the supply direction of the hydraulic oil toward the quick coupler cylinder 100.

The electronic proportional pressure reducing valve 500 is an electronically operated valve and may be composed of a solenoid portion for electrically generating magnetic force and a valve portion used as a flow path of a fluid.

The electronic proportional pressure reducing valve 500 generates a hydraulic pressure in response to an electrical signal applied by the controller 700, and the generated hydraulic pressure is transmitted from the electronic proportional pressure reducing valve 500 to the spool valve 400. The hydraulic pressure transmitted from the electronic proportional pressure reducing valve 500 moves the spool in the spool valve 400 in the axial direction and forms a pressure at the node of the flow pump 200, to which the spool valve 400 is connected.

Referring to FIGS. 3 and 5, for efficiency of controlling the spool valve 400 through the electronic proportional pressure reducing valve 500, the quick coupler circuit A according to an embodiment of the present invention may further include a solenoid valve 800 installed between the spool valve 400 and the electronic proportional pressure reducing valve 500.

The solenoid valve 800 serves to buffer the hydraulic pressure which is transmitted from the electronic proportional pressure reducing valve 500 to the spool valve 400. That is, the hydraulic pressure which is transmitted from the electronic proportional pressure reducing valve 500 to the spool valve 400 may be divided once or more, and the divided hydraulic pressure may be transmitted to the spool valve 400.

The quick coupler switch 600 is connected to the controller 700 and serves to transmit a signal according to an ON/OFF operation of the user to the controller 700.

The quick coupler switch 600 according to the embodiment of the present invention may be configured to be operated at two positions. More specifically, the quick coupler switch 600 may be configured to be operated at a locking position at which the attachment 7 is mounted on the working machine 4 by expanding and contracting the quick coupler cylinder 100 and may be configured to be operated at an unlocking position at which the attachment 7 is detached from the working machine 4 by expanding and contracting the quick coupler cylinder 100.

Accordingly, the quick coupler switch 600 of the present invention may be configured such that a single switch controls two positions, and thus the attachment and detachment of the attachment 7 may be controlled at once in the quick coupler circuit A.

The controller 700 is a member for controlling the switching of the spool valve 400 and the quick coupler valve 300 using the hydraulic pressure formed by outputting a current signal to the electronic proportional pressure reducing valve 500. The controller 700 may be connected to the electronic proportional pressure reducing valve 500 and controls the electronic proportional pressure reducing valve 500 in response to an operation signal of the quick coupler switch 600.

A specific operating method of the present invention based on the above structure is as follows.

First, the user operates the quick coupler switch 600. The controller 700 outputs a control current to the electronic proportional pressure reducing valve 500 in response to the above operation signal and a hydraulic pressure, which is formed by the electronic proportional pressure reducing valve 500 due to the control current, causes the spool valve 400 to operate. As a result, a pressure is formed at the node of the flow pump 200, which is connected to the spool valve 400, and the pressurized fluid passes through the quick coupler valve 300 and reaches the quick coupler cylinder 100 to finally operate the quick coupler cylinder 100.

In the construction machine 1 of the embodiment to which the present invention is applied, the attachment 7 may be exchanged using only one quick coupler switch 600 by using such an automatic pressurization system, inconvenience that the user should pressurize directly on the attachment 7 may be reduced, and thus the user's convenience may be improved.

When the above-described operating method is applied, the pressure at the node of the flow pump 200 is increased. In this case, due to the pressure being increased according to the operation of the present invention, a problem may occur in physical function being lowered when different attachments 7 connected to the node operate. In order to address such a problem, the quick coupler circuit A of the present invention needs to appropriately adjust an automatic pressurizing method using the controller 700.

Hereinafter, an embodiment of the present invention for addressing the above-described problem will be described with reference to FIG. 6.

In an initial stage after an operation signal which turns on the quick coupler switch 600, the controller 700 of the present invention outputs a control current command for forming a pressure which is high enough to open the electronic proportional pressure reducing valve 500 for a predetermined short period of time. Thereafter, the controller 700 may output a control current command for forming a relatively low pressure, thereby improving physical function of different attachments 7 affected by the pressure at one node of the flow pump 200.

That is, when the quick coupler switch 600 is ON, the controller 700 may output a first control current C1 which causes a pressure which is high enough to open the electronic proportional pressure reducing valve 500 for a predetermined first time T1.

In addition, after the first time T1 has elapsed, the controller 700 may output a second control current C2, which is relatively lower than the first control current C1, to the electronic proportional pressure reducing valve 500.

In this case, the first time T1 needs to be set more specifically for an operation which prevents the pressure at the node of the flow pump 200 from rising for a long time. In the actual construction machine 1, the first time T1 may be set to two seconds or less in consideration of the influence of the pressure at the same node of the flow pump 200 on the physical function of the attachments 7 connected to the same node.

Referring to FIG. 6, even after an operation signal which turns off the quick coupler switch 600, the controller 700 of the present invention may maintain a control current command constantly in the electronic proportional pressure reducing valve 500 for a predetermined short period of time to appropriately maintain a locking or unlocking speed of the attachment 7.

That is, when the quick coupler switch 600 is OFF, the controller 700 may output the second control current C2 to the electronic proportional pressure reducing valve 500 for a predetermined second time T2.

Further, after the second time T2 has elapsed, the controller 700 may output a third control current C3, which is relatively lower than the second control current C2, to the electronic proportional pressure reducing valve 500.

Hereinafter, another embodiment of the present invention for addressing the above-described problem will be described with reference to FIG. 7.

In an initial stage after an operation signal which turns on the quick coupler switch 600, the controller 700 of the present invention outputs a control current command for forming a pressure which is high enough to open the electronic proportional pressure reducing valve 500 for a predetermined short period of time. Thereafter, the controller 700 may reduce an output of a control current so as to reach a value of a limit control current for forming a relatively low pressure, thereby improving physical function of different attachments 7 affected by the pressure at one node of the flow pump 200.

That is, when the quick coupler switch 600 is ON, the controller 700 may output a control current which is reduced to reach a value of a first limit control current $C_L$1 lower than that of a first control current C1 which causes the pressure which is high enough to open the electronic proportional pressure reducing valve 500 for a predetermined first time T1.

More preferably, the control current output by the controller 700 may be reduced to have a predetermined magnitude for the first time T1 so as to reach the value of the first limit control current $C_L$1.

In addition, after a first time T1 has elapsed, the controller 700 may output a second control current C2, which is relatively lower than the first control current C1, to the electronic proportional pressure reducing valve 500.

Referring to FIG. 7, even after an operation signal which turns off the quick coupler switch 600, the controller 700 of the present invention may output the reduced control current to the electronic proportional pressure reducing valve 500 for a predetermined short period of time to appropriately maintain a locking or unlocking speed of the attachment 7.

That is, when the quick coupler switch 600 is OFF, the controller 700 may output a control current, which is reduced to reach a value of a second limit control current $C_L$2 lower than that of the second control current C2, to the electronic proportional pressure reducing valve 500 for a predetermined second time T2.

More preferably, the control current output by the controller 700 may be reduced to have a predetermined magnitude for the second time T2 so as to reach the value of the second limit control current $C_L$2.

In addition, after the second time T2 has elapsed, the controller 700 may output a third control current C3, which is relatively lower than the second limit control current $C_L$2, to the electronic proportional pressure reducing valve 500.

The first time T1, the second time T2, the first control current C1, the second control current C2, the third control current C3, the first limit control current $C_L$1, and the second limit control current $C_L$2 of the present invention, which are described with reference to FIGS. 6 and 7, are not limited to specific values and may be adjusted and selected in various manners according to an usage environment of the construction machine 1 of the embodiment to which the present invention is applied or a degree of a user's need.

Therefore, in the conventional quick coupler method in which the manual pressurizing is performed, the user has to perform many operations in order to give the attachment 7 which is changed or pressurized at a high engine speed a little more load, whereas the construction machine 1 of the embodiment to which the present invention is applied may be equipped with the above-described automatic pressurization system so that the user may control the construction machine 1 conveniently using only one switch.

Further, when the quick coupler switch 600 is turned on or off, it is possible to prevent the occurrence of a problem in physical function of different attachments 7 that may occur during the operation. Even when the quick coupler switch 600 is turned on or off, a certain level of locking or unlocking speed may be secured for a predetermined period of time. Therefore, the attachment 7 of the construction machine 1 may be exchanged more easily.

Additionally, another aspect of the present invention is to provide a construction machine having any one of the quick couple circuits according to an embodiment of the present invention.

The above description of the invention is only exemplary, and it will be understood by those skilled in the art that various modifications can be made without departing from the scope of the present invention and without changing essential features.

It will be apparent to those skilled in the art that various modifications can be made to the above-described exemplary embodiments of the present invention without departing from the spirit or scope of the invention. Thus, it is intended that the present invention covers all such modifications provided they fall within the scope of the appended claims and their equivalents.

The invention claimed is:

1. A quick coupler circuit of a construction machine with an automatic pressurization system, the quick coupler circuit comprising:

a quick coupler cylinder configured to attach and/or detach an attachment to and/or from construction machine by expansion and/or contraction;

a flow pump configured to supply fluid to the quick coupler cylinder;

a quick coupler valve through which fluid for operating the quick coupler cylinder passes;

a spool valve which includes a spool, configured to move along an axial direction, and to form a pressure at a node of the flow pump according to movement of the spool;

an electronic proportional pressure reducing valve configured to control the spool valve;

a quick coupler switch configured to perform an ON/OFF operation; and a controller configured to output a control current to the electronic proportional pressure reducing valve in response to the operation of the quick coupler switch, wherein the controller is further configured to maintain control current which it outputs during the quick coupler switch's ON operation for a predetermined period of time after the quick coupler switch's OFF operation;

wherein, when the quick coupler switch is ON, the controller outputs a first control current C1 which causes a pressure that opens the electronic proportional pressure reducing valve to be formed for a predetermined first time T1, and wherein, after the first time T1 has elapsed, the controller outputs a second control current C2, which is relatively lower than the first control current C1, to the electronic proportional pressure reducing valve.

2. The quick coupler circuit of claim 1, wherein the electronic proportional pressure reducing valve generates a hydraulic pressure according to the control current of the controller and transmits the generated hydraulic pressure to the spool valve to operate the spool valve.

3. The quick coupler circuit of claim 1, wherein, when the quick coupler switch is OFF, the controller outputs the second control current to the electronic proportional pressure reducing valve for a predetermined second time.

4. The quick coupler circuit of claim 3, wherein, after the second time has elapsed, the controller outputs a third control current, which is relatively lower than the second control current, to the electronic proportional pressure reducing valve.

5. The quick coupler circuit of claim 1, further comprising a solenoid valve installed between the spool valve and the electronic proportional pressure reducing valve.

6. A construction equipment which is equipped with the quick coupler circuit of claim 1.

7. A quick coupler circuit of a construction machine with an automatic pressurization system, the quick coupler circuit comprising:

a quick coupler cylinder configured to attach and/or detach an attachment to and/or from the construction machine by expansion and/or contraction;

a flow pump configured to supply fluid to the quick coupler cylinder;

a quick coupler valve through which fluid for operating the quick coupler cylinder passes;

a spool valve which includes a spool, configured to move along an axial direction, and to form a pressure at a node of the flow pump according to movement of the spool;

an electronic proportional pressure reducing valve configured to control the spool valve;

a quick coupler switch configured to perform an ON/OFF operation; and a controller configured to output a control current to the electronic proportional pressure reducing valve in response to the operation of the quick coupler switch, wherein the controller is further configured to output a decreasing control current, which is reduced until the value reaches a predetermined limit control current value, during a predetermined period of time after the quick coupler switch's OFF operation.

8. The quick coupler circuit of claim 7, wherein the electronic proportional pressure reducing valve generates a hydraulic pressure according to the control current of the controller and transmits the generated hydraulic pressure to the spool valve to operate the spool valve.

9. The quick coupler circuit of claim 7, wherein, when the quick coupler switch is ON, the controller outputs a control current, which is reduced to reach a value of a first limit control current lower than a first control current which causes a pressure that opens the electronic proportional pressure reducing valve to be formed for a predetermined first time.

10. The quick coupler circuit of claim 9, wherein, after the first time has elapsed, the controller outputs a second control current, which is relatively lower than the first limit control current, to the electronic proportional pressure reducing valve.

11. The quick coupler circuit of claim 10, wherein, when the quick coupler switch is OFF, the controller outputs a control current, which is reduced to reach a value of a second limit control current lower than that of the second control current, to the electronic proportional pressure reducing valve for a predetermined second time.

12. The quick coupler circuit of claim 11, wherein, after the second time has elapsed, the controller outputs a third control current, which is relatively lower than the second limit control current, to the electronic proportional pressure reducing valve.

13. The quick coupler circuit of claim 7, wherein the controller outputs a control current, which is reduced to have a predetermined magnitude so as to reach a value of a predetermined limit control current for a predetermined period of time after the quick coupler switch's OFF operation.

14. The quick coupler circuit of claim 7, further comprising a solenoid valve installed between the spool valve and the electronic proportional pressure reducing valve.

* * * * *